United States Patent [19]

Kallenbach

[11] 4,423,855

[45] Jan. 3, 1984

[54] THERMOCHEMICAL DRILLING AND SEPARATING PROCESS FOR $SI0_2$ CONTAINING MINERALS AND DEVICE FOR CARRYING OUT THE PROCESS

[76] Inventor: Rudolf Kallenbach, Birkeshöh 12, D 5882 Meinerzhagen 1, Fed. Rep. of Germany

[21] Appl. No.: 628,875

[22] Filed: Nov. 5, 1975

[30] Foreign Application Priority Data

Jul. 17, 1975 [DE] Fed. Rep. of Germany ..... 2531918

[51] Int. Cl.[3] ..... B23K 7/08

[52] U.S. Cl. ..... 266/74; 266/48; 285/322; 285/397; 285/419

[58] Field of Search ..... 266/48, 74, 75; 285/332, 397, 419; 110/1 R; 431/99; 148/9

[56] References Cited

U.S. PATENT DOCUMENTS

| | | | |
|---|---|---|---|
| 2,327,482 | 8/1943 | Aitchison et al. | 266/75 X |
| 3,540,757 | 11/1970 | Neher | 285/332 X |
| 3,650,515 | 3/1972 | Okui | 266/75 |
| 3,677,515 | 7/1972 | Fassler | 266/48 X |

FOREIGN PATENT DOCUMENTS

| | | | |
|---|---|---|---|
| 2300265 | 7/1974 | Fed. Rep. of Germany . | |
| 974115 | 11/1964 | United Kingdom | 285/397 |
| 1228338 | 4/1971 | United Kingdom | 285/419 |

OTHER PUBLICATIONS

"Erfahrungen mit det Sauerstofflanze", by Kurt Boeckhaus, in *Schweissen und Schneiden* 1/6/54 pp. 102–105.

"Silizium und Siligiumverbindungen" in *Chemie Fakten, 14,* pp. 208–209.

Lingscheidt, G., "Thermisches Bohren und Pulverschmelzscheiden von Beton" in *Der Praktiker,* 12/73 pp. 286–289.

Slottman, G. V. & Roper, E. H. *Oxygen Cutting* First Edition, McGraw-Hill Book Co. 1951, pp. 143–145.

*Primary Examiner*—Paul A. Bell

*Attorney, Agent, or Firm*—Allison C. Collard; Thomas M. Galgano

[57] ABSTRACT

Process and device for thermochemically drilling and separating $SiO_2$ containing minerals by using such chemical compounds as fluxes in the combustion, which form in the melt silicates of low temperature melting range, primarily alkali metal silicates, the fluxes, mixed with catalysts and with metal powder serving as fuel, being passed through an oxygen lance or a core lance containing bundles of wires and ducts for passage of oxygen and flux at a high rate of speed, ignition being done semi-automatically or fully automatically. The use of the process and device according to the invention result in an increased effectiveness of the drilling and separation of the $SiO_2$ containing minerals as compared to known thermochemical processes.

12 Claims, 13 Drawing Figures

THERMOCHEMICAL DRILLING AND SEPARATING PROCESS FOR $SI0_2$ CONTAINING MINERALS AND DEVICE FOR CARRYING OUT THE PROCESS

The invention relates to a thermochemical drilling and separating process for $SiO_2$ containing minerals and a device for carrying out the process. The expression "separating $SiO_2$ containing minerals" means a splitting of a mineral, not separating one mineral from another one.

The known art described a process, in which minerals are liquefied by heat in their melting range and separated (see "Schweissen und Schneiden", 1954, No. 3, page 102–105, and "Der Praktiker" 1973, No. 12, page 286–289.) The process is carried out with flame cutters, powder and core lances. In that process silicates are mainly formed which have a high melting range.

It is the object of the present invention to provide a process and device for drilling and separating minerals containing $SiO_2$ having a low melting range, which has the advantage of requiring less heat input and an increased drilling and separating effectiveness. Other objects and advantages of the process and device according to the invention will become apparent from the following description and the accompanying drawings. According to the invention, the thermochemical drilling and separating of $SiO_2$ containing minerals uses chemical compounds as fluxes in the combustion which form in the melt, with the aid of their $Na_2O$— or $K_2O$— groups, silicates of low melting range; these fluxes are mixed with catalysts and metal powder, serving as fuel, before they are fed into the combustion by being passed through a wire bundle in an oxygen lance which is ignited semi-automatically or fully automatically by an ignition device. Several oxygen lances may be combined by push-in pipe joints in order to provide lances of greater length. According to another feature, fluxes and metal powder with oxygen carriers may be introduced into the combustion packed in cartridges.

The invention relates in particular to forming alkali metal siliates, more specifically potassium silicate, because these silicates require the lowest heat input for melting. All other silicates have a higher melting range and their formation is less economical, so that in carrying out the process of the invention, the formation of other than alkali metal silicates is mostly avoided.

The device according to the invention is mainly characterized by the following features:

a mixer for the flux and the powder serving as fuel for the combustion;

a threadless pushed-in pipe joint for combining several combustion tubes so as to increase their length;

an arrangement of the combustion wires for the passage of flux and oxygen by free through-flow ducts;

an igniter for the combustion tube using counter current in a flow sleeve, operating semi-automatically or fully automatically; and an additional cartridge adding flux and combustion powder plus oxygen carrier, if desired.

Contrary to the known art, combustion tubes are used which are not threaded for connection. This avoids the disadvantage of known threaded tubes from becoming wetted by flux which makes them hard to screw in.

From the literature, drawings have become known which show seven wires in a bundle in a combustion tube. However, experience shows, that such bundles have no practical use, because the oxygen consumption is uneconomically high. These tubes differ from those used according to the invention, because they have to be rolled or made with indentations to decrease the oxygen input and for the purpose of holding the wires in place. In that arrangement, an attempt is made to increase the rate of oxygen flow and thereby the combustion effect, by deforming the walls and restricting the diameter of the tubes.

While in the device according to the invention, an arrangement is described which also uses a bundle of seven wires, the combustion rate is increased by providing free-flow ducts between the wires through which oxygen and flux can easily pass. There are thus no constrictions in the wall of the combustion tube and fastening of the wire bundle is effected by two curved portions in the tube.

In the German "Offenlegungsschrift" No. 2,300,265 of July 18, 1974 an ignition cartridge is disclosed, which operates by spontaneous combustion due to stored heat.

In the device according to the invention, combustion will only take place in conjunction with oxygen fed into the combustion tube. The ignition can be controlled by the operator by the amount of oxygen added. Until the combustion tube is ignited, the necessary heat is generated by increasing oxygen addition to the tube while in countercurrent heat flows through a flow sleeve. An ignition head can be activated by rubbing against a priming plate. The ignition head contains a priming mass which reacts at 225°–250° C. and may therefore be used automatically in cases when the temperature for the combustion tube, which is 1050° C., is not reached.

In the novel process the fact is made use of that substances capable of melting, pass into solution even below their melting range when their solvent is present in the liquid phase. This applies to $SiO_2$ of which a large amount is present in most minerals. It rapidly dissolves in an alkali metal melt. See "Chemie, Fakten u. Gesetze" Buch u. Zeitverlagsgesellschaft Köln 5th edition, page 209 (Chemistry, Facts and Laws).

The following alkalimetal silicates are being formed:

$Na_2SiO_3$ having a melting point of 1089° C.

$Na_2Si_2O_5$ having a melting point of 874° C.

$K_2Si_4O_9$ having a melting point of 815° C.

$K_2Si_2O_5$ having a melting point of 765° C.

when the following fluxes are added:

$Na_2CO_3$ of 854° C., or over $NaNO_3$ of 306° C., or over $K_2CO_3$ of 900° C., or over KOH of 410° C., or over By adding the metal oxides of copper, manganese, nickel and chromium to the flux, the highest oxidation stage of the silicate is reached in every case. Instead of the metal oxides, the metals themselves may be added, which will form oxides in the process. The addition of the mentioned oxides as catalysts is practiced particularly in order to obtain the potassium silicate $K_2Si_2O_5$.

By the addition of alkalies in a melt, the formation of high melting silicates, such as Fe- and Al-silicates is prevented.

In this process substantially the reactions of the following type are occurring:

$$Na_2CO_3 + nSiO_2 \rightarrow Na_2O \times nSiO_2 + CO_2;$$

$$NaHCO_3 + nSiO_2 \rightarrow Na_2O \times nSiO_2 + CO_2 + H_2O$$

In this process $$2KHCO_3+nSiO_2 \rightarrow K_2O \times nSiO_2+2CO_2+H_2O,$$

$$K_2CO_3+nSiO_2 \rightarrow K_2O \times nSiO_2+CO_2,$$

$$2KOH+nSiO_2 \rightarrow K_2O \times nSiO_2+H_2O,$$

which have the special characteristic of forming groups of the three atoms $Na_2O$ and $K_2O$ in the melt, which groups subsequently lead to the above-mentioned silicate formation.

The chemical compounds mentioned in the listing are only examples. Because of their large number, we cannot list here all the compounds which are useful for the purpose. Thus, according to the invention all chemical compounds may be used as fluxes which fulfill the condition of forming the groups of atoms $Na_2O$ and $K_2O$.

When $CO_2$ is split off from the flux, a side reaction occurs consisting of the reduction of metal oxides contained in the minerals, by way of dissociation of $CO_2$ to $CO+O$. This side reaction contributes to the formation of a low-temperature slag, by preventing Fe- and Al-silicates from being formed.

A proof that the reaction takes place is the occurence of a regulus in the slag consisting of the reduced metal formed from the oxides present in the minerals.

In using the process with flame cutters or powder lances, about 80% by weight of metal powder is added to the flux to serve as fuel carrier.

In the accompanying drawings the process of the invention is illustrated by way of example in conjunction with a flame cutter or a powder lance.

Figure 1:
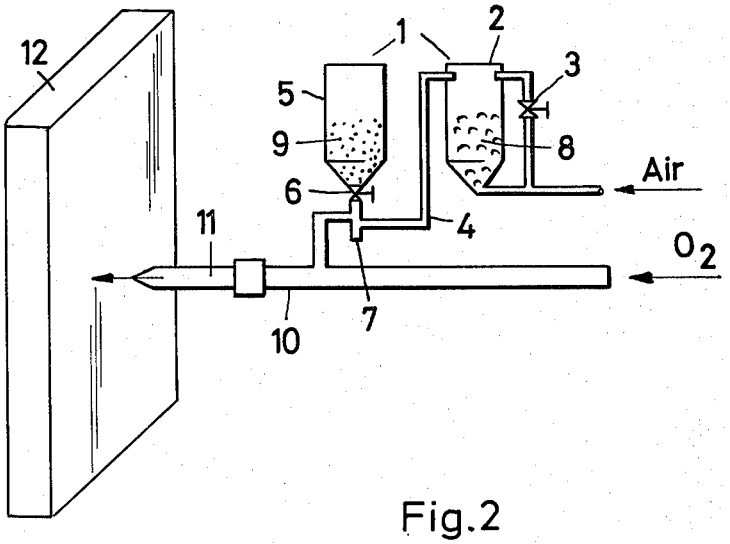
FIG. 1 is a schematic illustration of the device for carrying out the process with a oxygen lance.

Referring now to FIG. 1, the device comprises a mixer 1, consisting of a swirl chamber 2, a metering valve 3, a preliminary mixing tube 4, a powder chamber 5 with valve 6 and a mixing station 7. A powder lance is designated by 10, an oxygen lance by 11 and the material to be drilled or separated by 12. Into the swirl chamber a flux 8 is introduced and mixed with air whereupon it is metered by valve 3 into mixing tube 4 and arrives from there in mixing station 7; at the same time, fuel 9 is passed from powder chamber 5 by way of valve 6 into the mixing station in controlled amount, and contacts flux in said station.

The mixing device thus admits a desired mixture of flux 8 and fuel 9 to the powder lance 10 and the oxygen lance 11.

Figure 2:
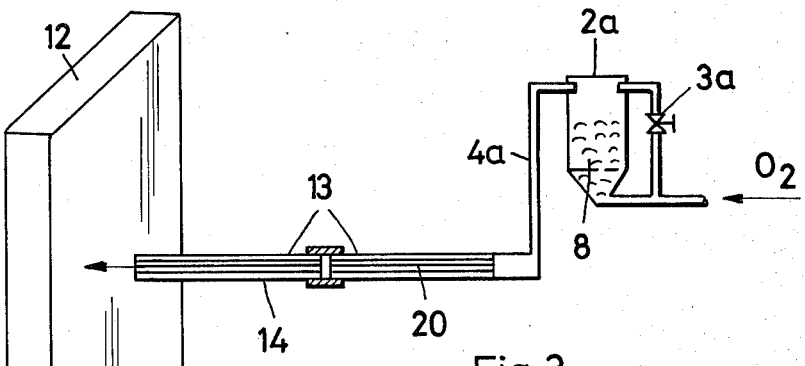
FIG. 2 is a similar illustration in which a core lance is used.

In FIG. 2 a core lance 13 is shown for carrying out the process in a device similar to the one described with reference to FIG. 1. A swirl chamber 2*a*, a metering valve 3*a* and a preliminary mixing tube 4*a* correspond to the respective elements of FIG. 1. The swirl chamber is again filled with flux 8. In the device according to FIG. 2, oxygen is admitted to chamber 2*a* and mixed with the flux which is then carried along to wire 20 and through combustion tube 14, forming part of the core lance 13. By adjusting the valve 3*a*, the amount of oxygen admitted for mixture with flux 8 may be controlled and varied.

Figure 3:
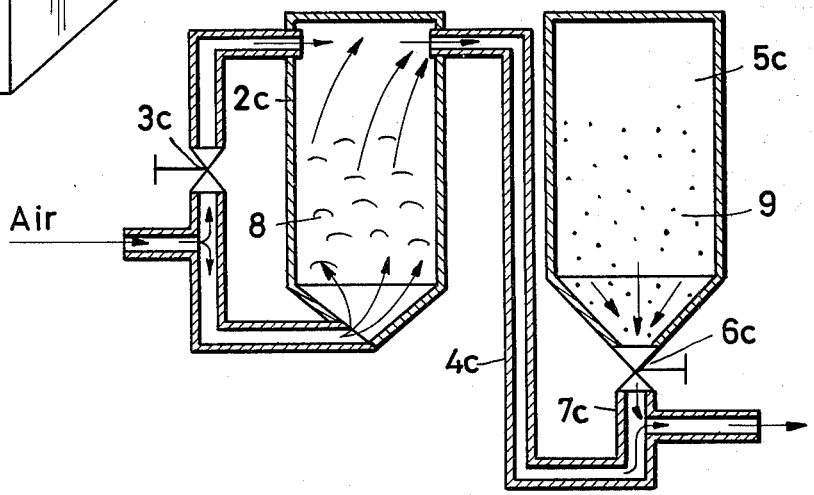
FIG. 3 shows a mixing device on an enlarged scale.

FIG. 3 illustrates the mixer 1 of FIG. 1 on an enlarged scale. The swirl chamber is designated by 2*c*, the metering valve by 3*c*, a preliminary mixing tube by 4*c*. The chamber 2*c* is filled with flux 8. The figure also shows the powder chamber 5*c* filled with fuel 9 and having a valve 6*c* through which the fuel is passed for mixture with flux into the mixing station 7*c*.

FIGS. 4 to 7 show different push-in connections of two combustion tubes.

Figure 4:
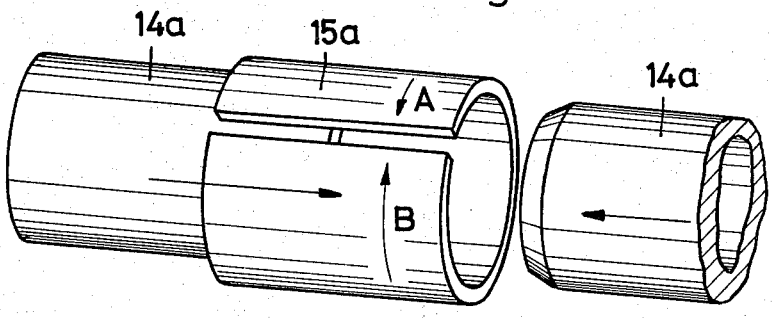
FIGS. 4 to 7 are a perspective showing of various connections for increasing the length of the combustion tube used in the device.

In FIG. 4, two combustion tubes 14*a* are shown with a connecting sleeve 15*a* to be slipped over the tubes and pressing them together by spring action. See arrows A and B.

Figure 5:
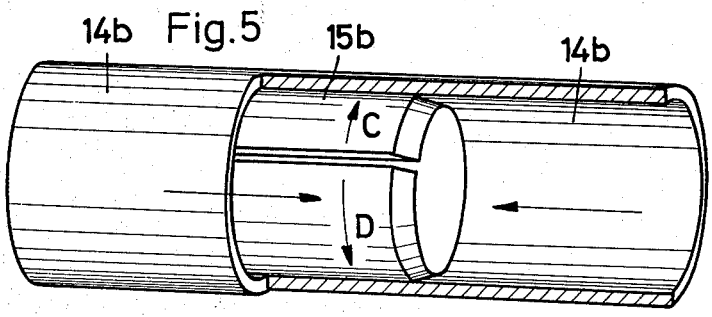

In FIG. 5 an assembled composite tube is shown, wherein a similar sleeve 15*b* is placed inside two tubes 14*b* exerting spring action in the sense of the arrows C and D for bringing about a tight fit.

Figure 6:
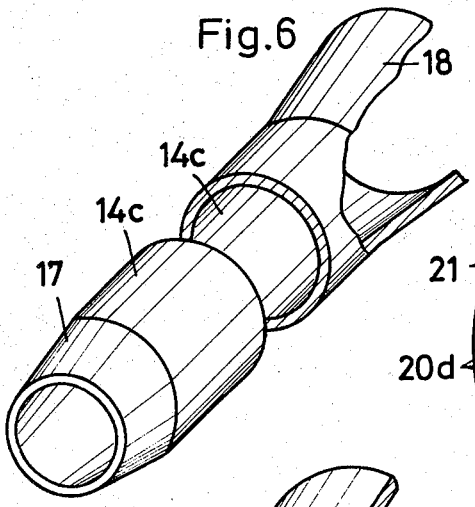
Figure 9:
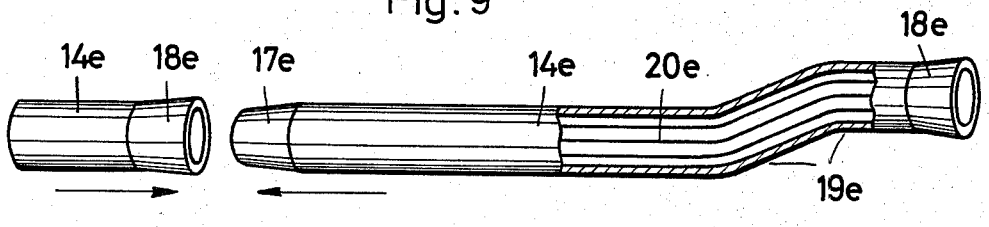
FIG. 9 is a longitudinal profile of the tube, partly in section.

FIG. 6 shows a similar, but somewhat modified push-in connection. In that case, combustion tube 14*c* carries, formed thereon, at one end an enlarged conical sleeve portion 18, at the other end a reduced cone portion 17. The connection can be made by fitting these portions together as shown in FIG. 9. The cone portions are self-limiting.

Figure 7:
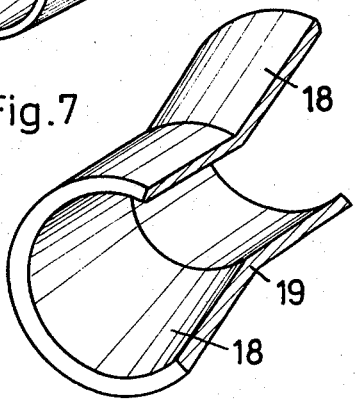

FIG. 7 shows a conical sleeve with two portions 18 for connecting a tube 14*c* illustrated in FIG. 6. 19 is an arc-shaped tube portion, better seen in FIG. 9.

Figure 8:
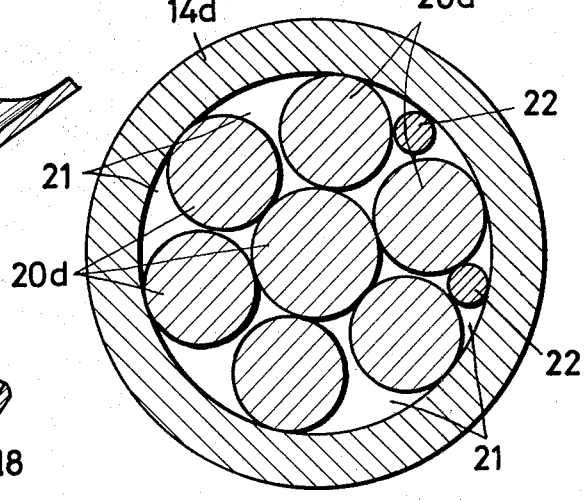
FIG. 8 illustrates, in cross section, a compound wire arrangement in the combustion tube of the device.

FIG. 8 is a cross section of a combustion tube 14*d*, corresponding to 14 of FIG. 1. There are 7 wires 20*d*, six of which are arranged hexagonally around the center wire, leaving passages 21 free for convection of oxygen plus flux. Also arranged in tube 14*d* are two filling wires 22, which may be copper wires.

FIG. 9 illustrates in longitudinal view and partly in section a combustion tube 14*e* with connecting cones 18*e* and 17*e* and wire bundle 20*e*; the latter remains in fixed position by means of arc-shaped portion 19*e*. The passages 21, mentioned in connection with FIG. 8, remain unchanged throughout the length of the combustion tube. The wall of the tube does not undergo any deformation as is the case in devices known in the art. Since oxygen plus flux are passing through the so arranged ducts, a high rate of flow will result without any excess consumption of oxygen, a fact which contributes to the economy of the process.

When known combustion tubes are used to carry out the process, it is necessary to remove some of the wires, whereby the heat fed into the process is diminished. Contrary thereto, the wire arrangement provided by the device according to the invention, shows a maximum of iron and heat input with passages 21 of large diameters, as proved by weight control and calculation.

Figure 10:
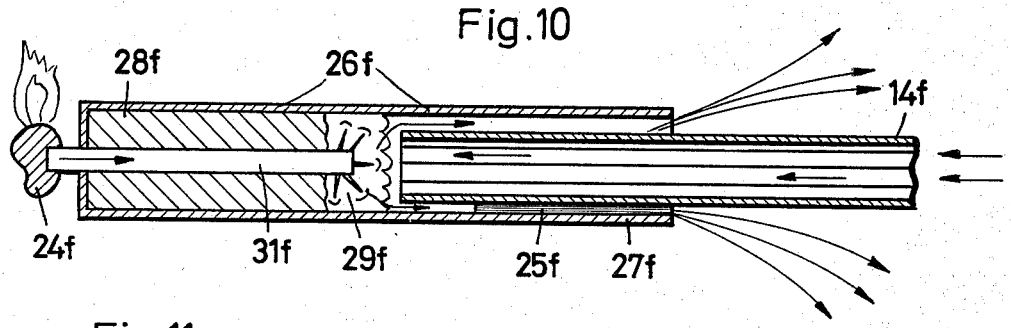
FIG. 10 shows the tube at the time when ignition occurs.
Figure 11:
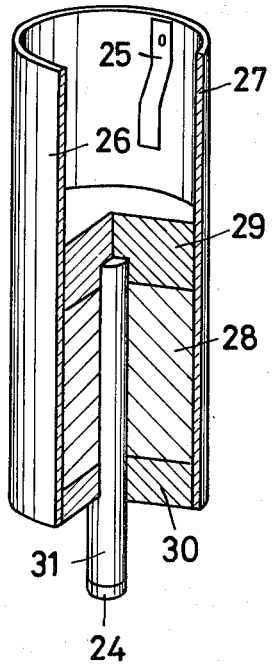
FIGS. 11–13 show various types of ignition cartridges.

FIGS. 10 and 11 illustrate an igniter and the manner in which ignition is brought about.

Referring first to FIG. 11, the igniter 26 is illustrated on an enlarged scale with part of the wall broken away. The igniter consists of a tube lined by a sleeve 27. A spring 25 holds the tube in place, as seen from FIG. 10. A metal powder forms the composition 28, serving as fuel for the combustion, while 29 is the igniting composition. For effecting ignition, a channel 31 connects composition 29 with an ignition head 24 containing a substance inflammable by friction.

Before ignition is effected, the combustion tube 14*f* is passed into the sleeve 27*f* where it is held in position by spring 25*f*. See FIG. 10. From ignition head 24*f*, the ignition channel 31*f* leads through powder 28*f* to ignition composition 29*f*. Moreover, oxygen is blown through tube 14*f* into the combustion 29, whereby powder 28*f* is spontaneously ignited. As the combustion proceeds, hot combustion gases escape in countercurrent through sleeve 27*f* and ignite the combustion tube 14*f* instantaneously. Subsequently, that tube is moved continuously into the burning powder 28*f* and as it hits mineral 12 shown in FIG. 1, not only burning continues, but drilling is started. This has the advantage that combustion tube 14*f* cannot be extinguished once it started burning, which might occur, if the tube were only set to drilling later.

It is another advantage that the operator is outside of the danger zone contrary to other processes such as welding torches.

The igniting composition 29 and channel 31 contain chemical substances which will undergo spontaneous combustion at higher than atmospheric temperatures. Thus, automatic ignition can be used by choosing appropriate temperatures.

Figure 13:
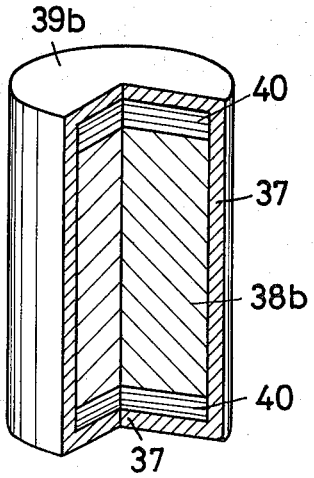
Figure 12:
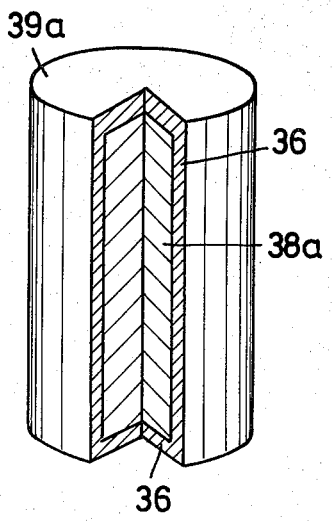

FIGS. 12 and 13 show cartridges, which may be additionally used in the process according to the invention.

The cartridge 39*a* of FIG. 12 consists of a tube 36 filled with flux 38*a*, cartridge 39*b* of FIG. 13 is filled with flux 38*b* in combination with combustion powder and an oxygen carrier 40.

In the following a few examples will be given for the effect of the method according to the invention.

EXAMPLE 1

(a) An $SiO_2$ containing wall was cut with a oxygen lance 11, pure iron powder being used as fuel. The rate of cutting was determined to be 0.9 m per hour.

(b) The method of cutting was then carried out with iron powder, to which 20% by weight were added of a flux containing 30% $Na_2CO_3$, 40% $K_2CO_3$, 20% $KNO_3$, 9% $K_2B_4O_7$, and 1% $MnO_2$, all percentages being by weight. The cutting rate was increased to 1.55 m per hour.

EXAMPLE 2

(a) The wall used as in example 1 was cut by a oxygen lance using a fuel of 85% by weight of iron powder and 50% by weight of aluminum powder. The cutting rate was 2 m per hour.

(b) In a second run 20% by weight of a flux was added consisting of 30% $NaCHO_3$, 60% $KHCO_3$, 3% $KNO_3$, 5% $K_2B_4O_7$, 1% $MnO_2$, 0.5% CuO and 0.5% NiO. The cutting rate increased to 3.3 m per hour.

As mentioned before, the process and device according to the invention have the advantage of being more effective than known processes and devices of similar nature. The actual effect depends on the contents of $SiO_2$ in a mineral. But even a concrete mixture 1:1 has in general an $SiO_2$ content above 70%. The remaining 30% of metal oxides are sufficiently attacked by the reducing action of the CO set free from the flux. This reduction prevents the formation of slag becoming liquid only at high temperatures. The formation of low-melting slags takes place mostly according to the laws of the thermochemical series.

What is claimed is:

1. A device for thermochemically drilling and separating $SiO_2$-containing minerals comprising:

a mixer including a swirl chamber for mixing a flux with oxygen, and means for regulating the amounts of flux and oxygen mixed together;

a consumable oxygen lance for carrying out the drilling and separating operation, coupled to said mixer, said lance having an elongated combustion tube, and a plurality of combustion wires disposed in said tube defining channels therebetween for the flow of flux and oxygen therethrough.

2. The device according to claim 1, wherein two of said combustion tubes are provided and wherein said device also includes means for connecting said two combustion tubes, said means consisting of unthreaded push-in joints.

3. The device according to claim 2, wherein the push-in joint is a resilient sleeve.

4. The device according to claim 2 wherein the push-in joint consists of two cones, one cone formed at the end of each tube, to be connected, one cone having a flaring profile, the other cone forming a correspondingly tapering profile.

5. The device according to claim 1, also containing an igniting unit for starting the combustion in said tube, said unit consisting of a sleeve lining the tube wall outwardly thereof, a spring for fastening the lining to the tube, metal powder partly filling said sleeve, an igniting composition adjacent to the metal powder in said sleeve, an ignition channel arranged in the center of the sleeve to connect the igniting composition to an ignition head containing a substance inflammable by friction.

6. The igniting unit according to claim 5, containing in the ignition channel and in the ignition composition chemical compounds which undergo spontaneous combustion when the temperatures are higher than normal atmospheric temperatures.

7. The device of claim 1, wherein said tube has a curved wall portion which securely fastens said wires in said tube.

8. The device of claim 7, wherein said wires comprise a central wire coaxially disposed in said tube with the other wires arranged in a bundle around said central wire.

9. The device of claim 1, additionally including an igniter mountable onto one end of said lance, said igniter comprising a cap receivable on the end of said lance and having a cup-shaped chamber formed therein in which is disposed combustible material, said cup-shaped chamber being of a cross section enabling insertion of said end of said lance thereinto and having at least one gas venting passageway formed and extending from the bottom exterior of said cup-shaped chamber to the exterior of said cup when said cup is mounted on said lance end, and igniting means for igniting said combustible material to thereby enable ignition of said one end of said lance.

10. The device of claim 9, wherein said igniting means has an ignition head containing a substance flamable by friction.

11. The device of claim 9, wherein said igniting means comprises an igniting composition containing a chemical substance which will undergo spontaneous combustion at a higher-than-atmosphere temperature.

12. The device of claim 1, wherein said mixer includes a powder chamber for supplying fuel for a combustion, means for regulating the amount of fuel supplied and a mixing station for preparing therein a mixture of flux and fuel for the combustion and connecting means for supplying the mixture from said mixing station to said lance for sustaining combustion in said lance.

* * * * *